US005395102A

United States Patent [19]

Eguchi

[11] Patent Number: 5,395,102

[45] Date of Patent: Mar. 7, 1995

[54] PAPER SHEET FEEDING APPARATUS

[75] Inventor: Takeshi Eguchi, Oomiya, Japan

[73] Assignee: Kabushiki Kaisha Toshiba, Kawasaki, Japan

[21] Appl. No.: 9,972

[22] Filed: Jan. 26, 1993

[30] Foreign Application Priority Data

Feb. 6, 1992 [JP] Japan ..... 4-020979

[51] Int. Cl.[6] ..... B65H 5/00

[52] U.S. Cl. ..... 271/10; 271/270; 355/313

[58] Field of Search ..... 271/270, 258; 355/313

[56] References Cited

U.S. PATENT DOCUMENTS

| | | | |
|---|---|---|---|
| 4,519,700 | 5/1985 | Barker | 271/270 X |
| 4,522,483 | 6/1985 | Matsumoto | 355/3 R |
| 4,634,263 | 1/1987 | Miwa | 271/270 X |
| 4,780,745 | 10/1988 | Kodama | 271/270 X |
| 4,937,634 | 6/1990 | Hirabayashi | 271/270 X |
| 4,993,699 | 2/1991 | Takahashi | 271/291 X |
| 5,018,716 | 5/1991 | Yoshida | 271/270 X |
| 5,018,718 | 5/1991 | Matsuno | 271/270 X |
| 5,151,797 | 9/1992 | Nosaki | 358/474 |

FOREIGN PATENT DOCUMENTS 2-221970 9/1990 Japan .

*Primary Examiner*—H. Grant Skaggs
*Assistant Examiner*—Carol L. Druzbick
*Attorney, Agent, or Firm*—Foley & Lardner

[57] ABSTRACT

A paper sheet feeding apparatus includes a driving motor having a driving gear rotatable in forward and reverse directions, a first driven gear engaged with the driving gear and rotating only in the forward direction, a second driven gear having a different number of teeth than the first driven gear and rotatable only in the reverse direction, a pick-up roller, driven by rotation of the first or second driven gear, for picking up paper sheets, a paper sheet feeding roller for feeding paper sheets picked up by the pick-up roller, a separating roller for separating, one by one, paper sheets which are supplied from the paper sheet feeding roller, and a resist roller for aligning the paper sheets supplied from the paper sheet feeding roller. The speed of the paper sheet feeding apparatus can be changed in accordance with the speed of an image forming apparatus to which the paper sheet feeding apparatus is connected.

2 Claims, 7 Drawing Sheets

PAPER SHEET FEEDING APPARATUS

BACKGROUND OF THE INVENTION

1. Field of the Invention

This invention relates to a paper sheet feeding apparatus which is attached to an image forming apparatus such as an electronic copying machine.

2. Description of the Related Art

An electronic copying machine has a photosensitive drum, on which an electrostatic latent image of an original is formed. The electrostatic latent image is developed by toner supplied from a developing apparatus. The developed image is transferred to a paper sheet by the function of a transferring charger.

The paper sheet is supplied from, for example, a sheet feeding apparatus mounted on a stage as disclosed in Published Unexamined Japanese Patent Application (PUJPA) No. 2-221970.

Electronic copying machines vary in image forming speed depending on the type. Therefore, it is necessary to change the speed of transferring paper sheets in a sheet feeding apparatus in accordance with the image forming. However, since the conventional sheet feeding apparatus feeds sheets at a constant speed, if the image forming apparatus of a copying speed is changed to another apparatus of a different copying speed, the sheet feeding apparatus cannot supply sheets to the image forming apparatus.

Therefore, according to the conventional art, it is necessary to prepare paper sheet feeding apparatuses of a number which coincide with the number of types of the image forming apparatuses, resulting in a high cost.

If the driving mechanism of the paper sheet feeding apparatus is changed in accordance with the copying speed of the image forming apparatus, paper sheets can be fed to the image forming apparatus using a reduced number of paper sheet feeding apparatuses. However, in this case, much trouble and time are required to set up the driving mechanism.

SUMMARY OF THE INVENTION

It is accordingly an object of the present invention to provide a paper sheet feeding apparatus wherein the paper sheet transferring speed is variable in accordance with the image forming speed without changing the driving mechanism or the like.

According to an aspect of the present invention, there is provided a paper feeding apparatus, connectable to one of a plurality of kinds of an image forming apparatus, comprising: means for storing a number of sheets; means for feeding the sheet from the storing means to the image forming apparatus at a predetermined feeding speed, when the paper feeding apparatus is connected to the image forming apparatus; and means for changing the sheet feeding speed of the feeding means in accordance with the kind of the image forming apparatus which is connected to the paper feeding apparatus.

According to another aspect of the present invention, there is provided a paper feeding apparatus, connectable to one of a plurality of kinds of an image forming apparatus, comprising: means for storing a number of sheets; means for feeding the sheet from the storing means to the image forming apparatus at a predetermined feeding speed-when the paper feeding apparatus is connected to the image forming apparatus; a first driving means for driving the feeding means at a first feeding speed; a second driving means for driving the feeding means at a second feeding speed which is different from the first speed; and means for selectably operating the first driving means and the second driving means.

According to still another aspect of the present invention, there is provided a paper sheet feeding apparatus comprising: a paper feeding apparatus, connectable to one of a plurality of kinds of an image forming apparatus, comprising: means for receiving a signal, for showing a paper feeding speed, outputted from the image forming apparatus; means for storing a number of sheets; means for feeding the sheet from the storing means to the image forming apparatus at a predetermined feeding speed when the paper feeding apparatus is connected to the image forming apparatus; and means for controlling the feeding means to feed the paper at a speed in accordance with the signal received by the receiving means.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

An embodiment of the present invention will now be described with reference to FIGS. 1 to 4.

Figure 1:
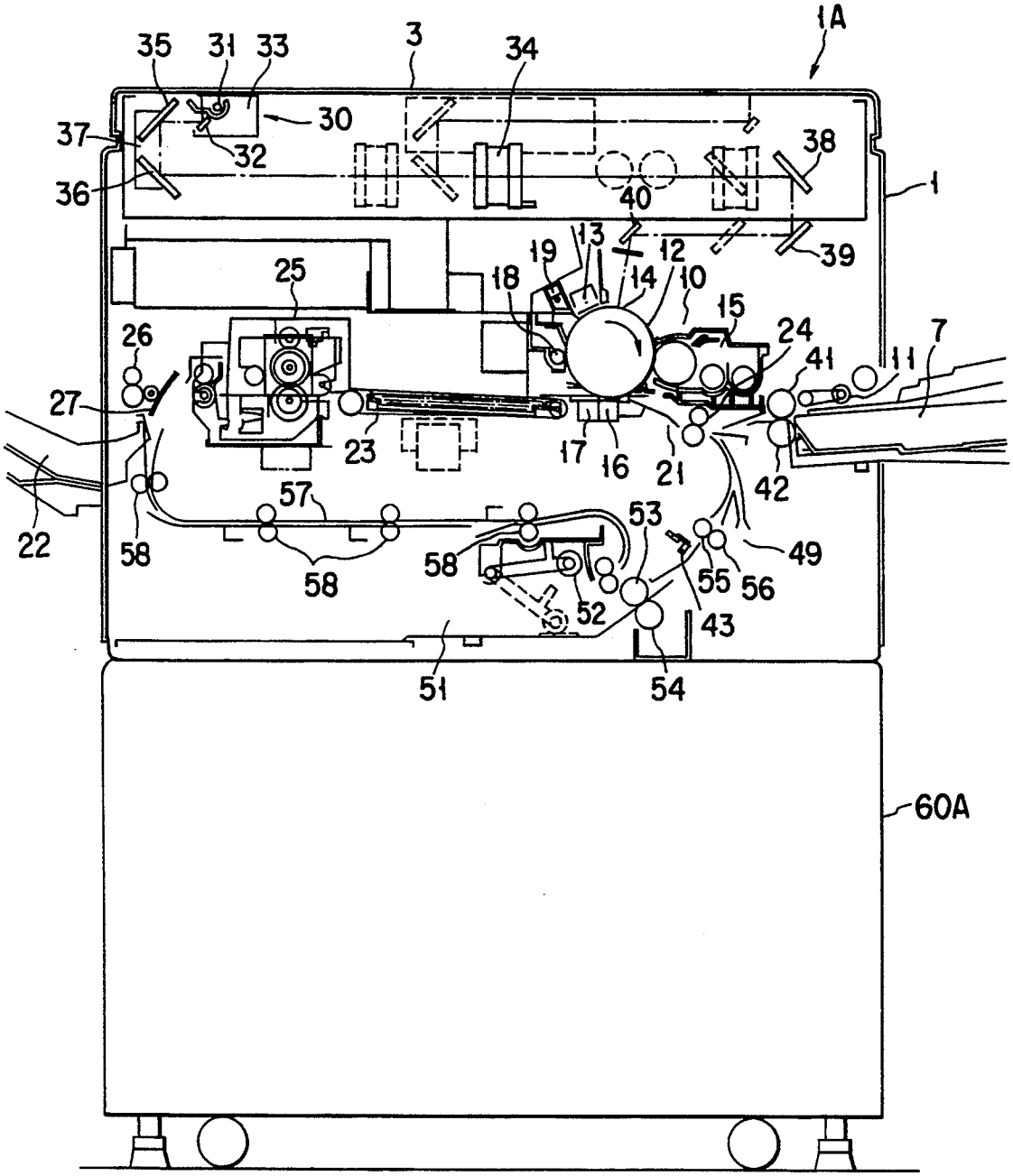
FIG. 1 is a schematic diagram showing an image forming apparatus mounted on a paper sheet feeding apparatus according to an embodiment of the present invention.

FIG. 1 is a schematic diagram showing an image forming apparatus 1A. A main body 1 of the image forming apparatus 1A is mounted on the upper surface of a housing (paper sheet feeding apparatus main body) 60 of a paper sheet feeding apparatus 60A.

An original table glass 3 is disposed on the upper surface of the main body 1.

An exposure means 30 is provided in an upper portion of the main body 1. The exposure means 30 includes first and second carriages 33 and 37 which move along the original table glass 3. The first carriage comprises a light source 31 and a first mirror 32. The second carriage 37 comprises second and third mirrors 35 and 36. A lens 34 is provided in the light path of a light beam reflected by the third mirror 36. The light beam passed through the lens 34 is image-formed on a photosensitive drum 12 through fourth to sixth mirrors 38, 39, and 40. An image forming means 10 is positioned adjacent to the photosensitive drum 12. The image forming means includes an electric charger 13, an exposing section 14, a transferring charger 16, a peeling charger 17, a cleaning apparatus 18, and an electric discharger 19, arranged in this order in the direction of rotation of the photosensitive drum 12.

A paper sheet cassette 7 is detachably attached to a side portion of the main body 1. Paper sheets are drawn from the paper sheet cassette 7 by a pick-up roller 11. Thereafter, the paper sheets are separated from one another and transferred forward by a sheet feeding roller 41 and a separating roller 42. Then, the paper sheets are transferred along a transfer path 21.

In the transfer path 21, an aligning roller 24, the transferring and peeling chargers 16 and 17, a transfer belt 23, a fixing apparatus 25, and a paper sheet discharging roller 26 are arranged in this order in the direction of transference of paper sheets.

The main body 1 includes, in its bottom portion, a stacking section 51 for use in two-side image forming, wherein paper sheets with images formed on one side thereof are temporarily stacked. The paper sheets in the stacking section 51 are drawn by a drawing roller 52. The paper sheets drawn by the drawing roller 52 are supplied to the aligning roller 24 through a transfer path 49. The transfer path 49 includes a paper sheet feeding roller 53, a separating roller 54, a sheet sensor 43, a positioning roller 55, and a driven roller 56 which is in contact with the positioning roller 55.

A plurality of transfer rollers 58 are provided along a transfer guide 57 formed above the stacking section 51. In a two-side image forming operation, a paper sheet passed through the fixing apparatus 25 is guided to the transfer guide 57 by a gate 27 and transferred by the transfer roller 58 to the stacking section 51.

Figure 3:
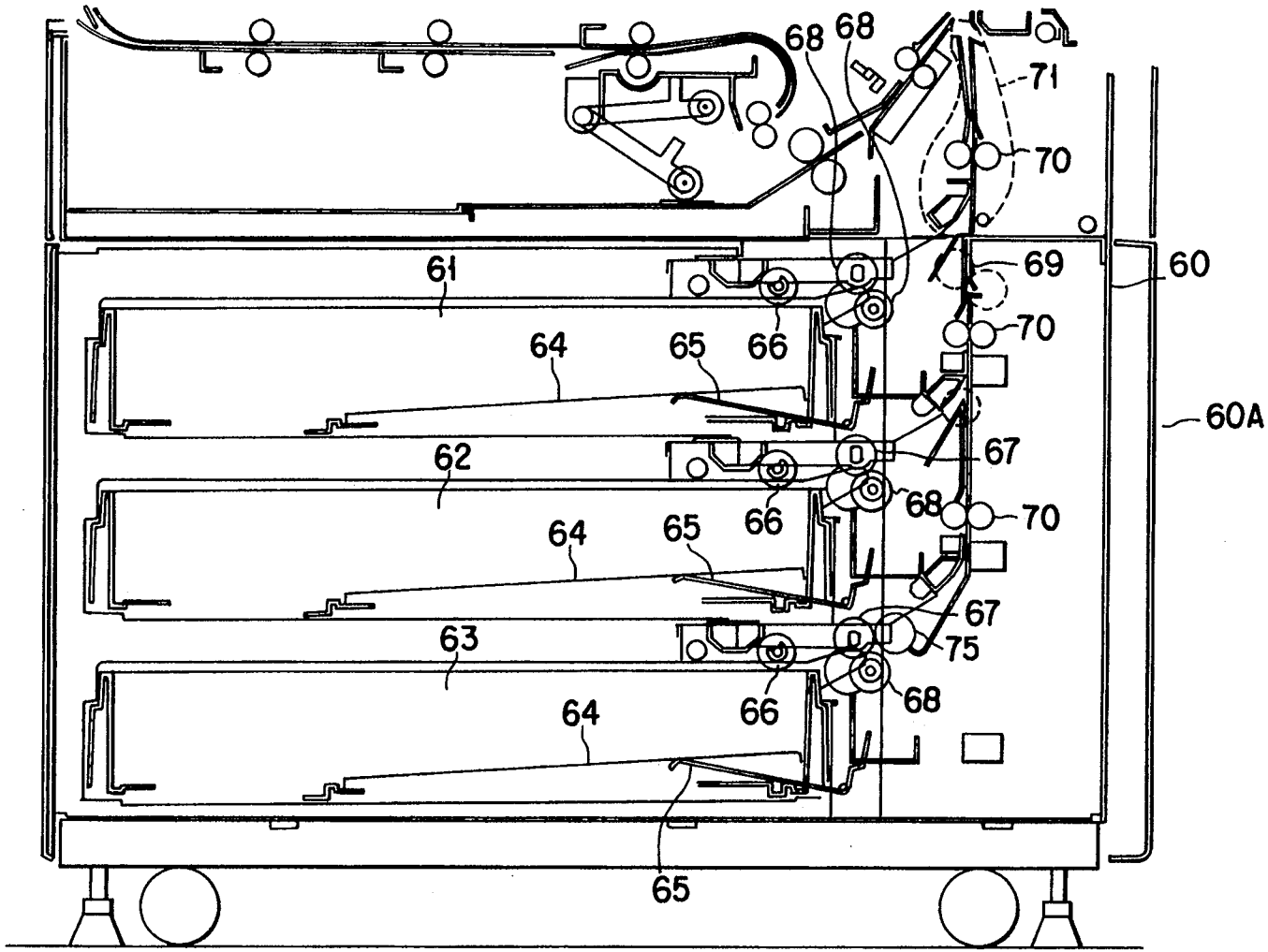
FIG. 3 is a diagram showing the structure of the paper sheet feeding apparatus driven by the driving system shown in FIG. 2.

As shown in FIG. 3, upper, middle and lower paper sheet cassettes 61, 62, and 63 are detachably inserted in the housing of the paper sheet feeding apparatus 60A. Each of the paper sheet cassettes includes a tray 64 on which paper sheets are stacked. The tray 64 is movable upward by means of an elevator 65. A pick-up roller (transfer means) 66, which is movable up and down, is mounted on the upper portion of each of the paper sheet cassettes 61 to 63, so that a paper sheet can be picked up by the pick-up roller 66 from the cassette. A paper sheet feeding roller (transfer means) 67 and a separation roller 68 abutted thereon are provided for each of the paper sheet cassettes 61 to 63 on the side in which a paper sheet is picked up by the pick-up roller 66. The paper sheet picked up by the pick-up roller 67 is guided upward by a guide portion 69 extending in a vertical direction. A plurality of resist rollers (transfer means) 70 are provided in the guide portion 69. The upper end portion of the guide portion 69 is connected to a relay unit 71 in the main body 1, so that a paper sheet can be supplied to the aligning roller 24 in the main body 1 through the relay unit 71. The resist rollers 70 are also provided in the relay unit 71.

Figure 2:
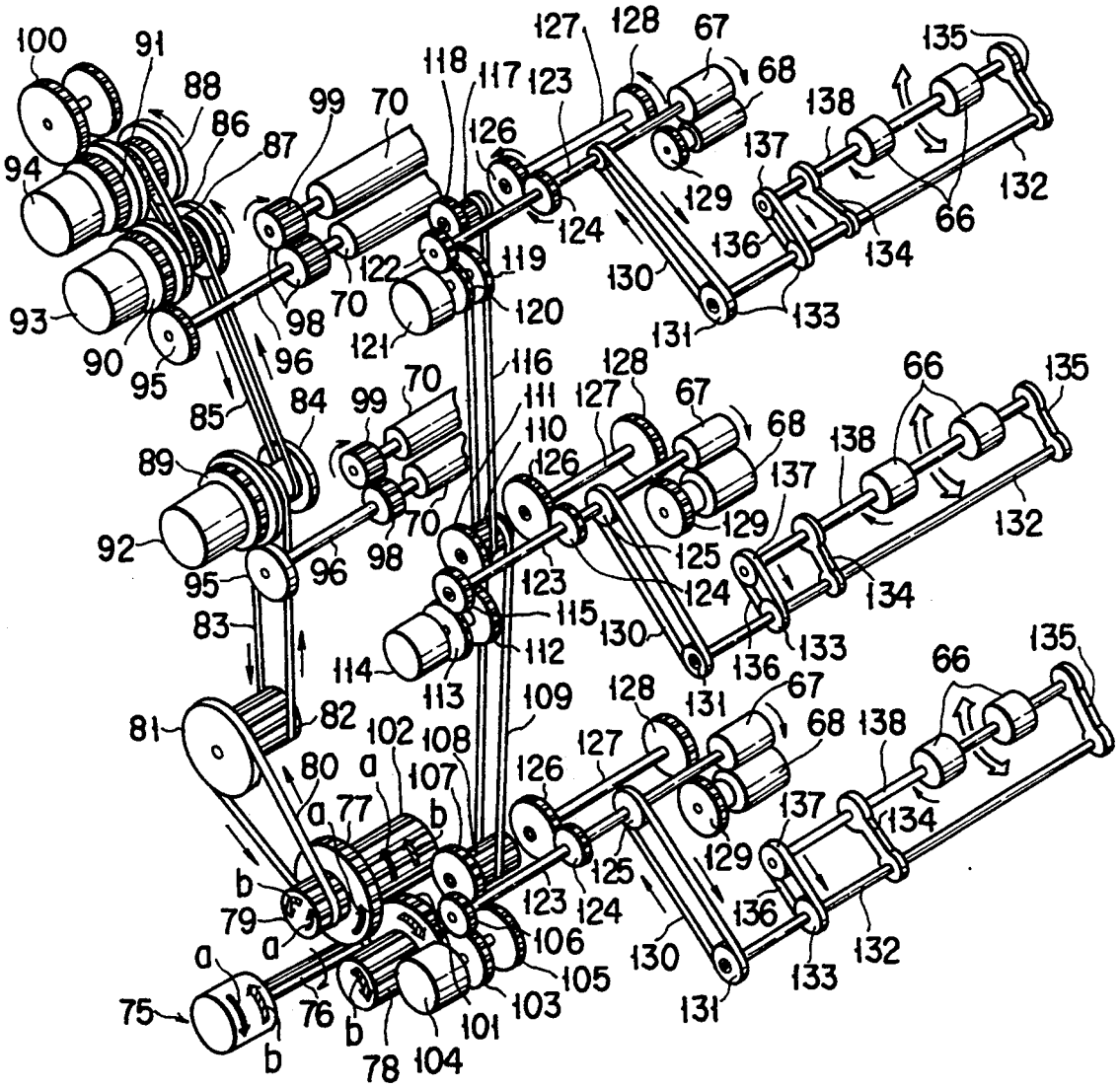
FIG. 2 is a perspective view showing the driving system of the paper sheet feeding apparatus shown in FIG. 1.

The above-mentioned pick-up roller 66, sheet feeding and separating rollers 67 and 68 and, resist rollers 70 are rotationally driven by a driving mechanism as shown in FIG. 2.

As shown in FIG. 2, a motor 75 mounted on the housing 60 has a driving gear 76, which is engaged with first and second driven gears 77 and 78. A timing pulley 79 coaxially fitted on the first gear 77 is connected to a timing pulley 81 via a timing belt 80. A timing pulley 82 coaxially fitted on the timing pulley 81 is connected to a timing pulley 84 via a timing belt 83. The timing pulley 84 is connected to a timing pulley 86 via a timing belt 85. The timing pulley 86 is connected to a timing pulley 88 via a timing belt 87. The timing pulleys 84, 86, and 88 are coaxially provided with gears 89, 90, and 91, respectively. Power is intermittently transmitted from the timing pulleys 84, 86, and 88 via clutches 92, 93, and 94 to the gears 89, 90, and 91. The gear 89 is engaged with a gear 95, which is connected to the (lower) resist roller 70 via a shaft 96. A gear 98 is fixed on the shaft 96 and connected to the (upper) resist roller 70 via a gear 99. The gear 91 is connected to a gear 100, which is connected to the resist roller 70 of the relay unit 71.

The second driven gear 78 is coaxially provided with a gear 101, which is engaged with a gear 103. A clutch 104 and a gear 105 are coaxially fixed to the gear 103. The gear 103 is engaged with a gear 106 and the gear 105 is engaged with a gear 107. The gear 107 is coaxially provided with a timing pulley 108, which is connected to a timing pulley 110 via a timing belt 109. The timing pulley 110 is coaxially provided with a gear 111, which is engaged with a gear 112. The gear 112 is coaxially connected to a gear 113 and a clutch 114. The gear 113 is engaged with a gear 115. The timing pulley 110 is connected to a timing pulley 117 via a timing belt 116. The timing pulley 117 is coaxially provided with a gear 118, which is engaged with a gear 119. The gear 119 is coaxially provided with a gear 120 and a clutch 121. The gear 120 is engaged with a gear 122.

The gears 106,115, and 122 are connected to the paper sheet feeding rollers 67 via shafts 123.

Each of the shafts 123 has gears 124 and 125. The gear 124 is connected to the separating roller 68 via a gear 126, a shaft 127, a gear 128, and a gear 129. The gear 126 is connected to a timing shaft 132 via a timing belt 130 and a timing pulley 131. A timing pulley 133 and rotational arms 134 and 135 are provided on the shaft 132. The timing pulley 133 is connected to a shaft 138 via a timing belt 136 and a timing pulley 137. The shaft 138 is supported by rotational ends of the rotational arms 134 and 135. The pick-up rollers 66 are fitted on the shaft 138. The first and second driven gears 77 and 78 are respectively provided with one-way clutches (not shown). Owing to the function of the one-way clutches, the first driven gear 77 is rotated only in a direction indicated by an arrow a and the second driven gear 78 is rotated only in a direction indicated by an arrow b shown in FIG. 2.

The first driven gear 77 has 80 teeth and the second driven gear 78 has 25 teeth. The driving gear 76 of the driving motor 75, which is engaged with the first and second driven gears 77 and 78, has 10 teeth.

In an image forming process, an original is set on the original table glass 3 and exposed to light emitted from the light source 31. Light reflected by the original is applied to the lens 34 via the first to third mirrors 32, 35, and 36. The reflected light is passed through the lens 34 and applied to the peripheral surface of the photosensitive body 12 via the fourth to sixth mirrors 38, 39 and 40, thereby forming an electrostatic latent image thereon. The electrostatic latent image is transferred to the developing apparatus 15, in which the latent image is developed to a visible image by a developer. The visible image is transferred by the transferring charger 16 to a paper sheet supplied from the paper sheet cassette 7 or the paper sheet cassettes 61 to 63 of the paper sheet feeding apparatus 60A. The paper sheet on which the image is transferred is peeled off the photosensitive body 12 by the function of the peeling charger 17, and transferred by the transfer belt 23. The paper sheet is supplied to the fixing apparatus 25, wherein the transferred image is fixed to the sheet. The paper sheet on which the image is printed is discharged to a discharge tray through the sheet discharging roller 26.

Image forming apparatuses vary in image forming speed depending on the type, for example, 125 mm/s, 250 mm/s or the like. Therefore, the sheet transfer speed of the paper sheet feeding apparatus must be changed in accordance with the image forming speed of the image forming apparatus. According to this embodiment, the sheet transfer speed can be changed by rotating forward or reverse the driving motor 75 of the sheet feeding apparatus 60A.

For example, when the image forming speed is 125 mm/s, the driving motor 75 is driven in a direction indicated by the arrow a in FIG. 2. As a result, the first driven gear 77 is rotated in a direction of the arrow a, and the gear 102 and the timing pulley 79 are also rotated in the same direction. By the rotation of the timing pulley 79, the timing belts 80, 83, 85, and 87 are run, thereby rotating the pulleys 84, 86, and 88 and the gears 89, 90, and 91. By the rotation of the gears 89, 90, and 91, the resist rollers 70 are rotated via the gears 95, the shafts 96, the gears 98, and the gears 99. By the rotation of the gear 102, the pulley 108 and the gear 105 are rotated via the gear 107. By the rotation of the pulley 108, the timing belts 109 and 116 are run, thereby rotating the gears 111, 112, 113, and the gears 118,119, and 120. As a result, the gears 115 and 112 are rotated. By the rotation of the gear 105, the gear 106 is rotated via the gear 103.

By the rotation of the gears 106,115, and 122, the paper sheet feeding rollers 67 are rotated through the shafts 123. As the same time, the separating rollers 68 are rotated through the gears 124 and 126, the shafts 127, and the gears 128 and 129. Further, since the gears 125 are rotated in accordance with the shafts 123, the shafts 132 are rotated via the timing belts 130 and the timing pulleys 131. By the rotation of the shafts 132, the shafts 138 are rotated via the timing pulleys 133, the timing belts 136, and the timing pulleys 137, thereby rotating the pick-up rollers 66. As a result, paper sheets in the paper sheet cassettes 61 to 63 are drawn by the pick-up rollers 66 and supplied to the paper sheet feeding rollers 67. The paper sheets are separated from one another by the rotation of the paper sheet feeding rollers 67 and the separation rollers 68, and supplied one by one to the guide portion 69. The paper sheets which have been supplied to the guide portion 69 are aligned by the resist rollers 70, and transferred to the image transfer section in the main body 1 through the relay unit 71.

When a image forming apparatus in which the image forming speed is 250 mm/s is used, the driving motor 75 is driven in a direction indicated by the arrow b. As a result, the second driven gear 78 is rotated in the direction of the arrow b and the gear 101 is rotated in the same direction. By the rotation of the gear 101, the gears 103 and 105 are rotated. The gears 106 and 107 are rotated owing to the rotation of gears 103 and 105, respectively. By the rotation of the gear 107, the gear 102 is rotated. Subsequently, the resist rollers 70 are rotated in the same manner as described above. Further, the timing pulley 108 is rotated by the rotation of the gear 107. Owing to the rotation of the timing pulley 108 and the gear 106, the paper sheet feeding rollers 67, the separation rollers 68, and the pick-up rollers 66 are rotated, thereby transferring paper sheets.

As has been described above, the driving motor 75 is driven in the forward or reverse direction, thereby selectively rotating the first gear 77 (having 80 teeth) and the second gear 78 (having 25 teeth) by the rotating gear 76 (having 10 teeth). Since the sheet transfer speed is thus variable, the sheet transfer speed can be changed in accordance with the image forming speed. Therefore, it is unnecessary to provide paper sheet feeding apparatuses of a number which coincide with the number of types of the image forming apparatuses, and the cost can be reduced.

In addition, unlike a case where the driving mechanism of the paper sheet feeding apparatus is replaced with another one, no trouble and time are required to set up a driving mechanism.

Figure 4:
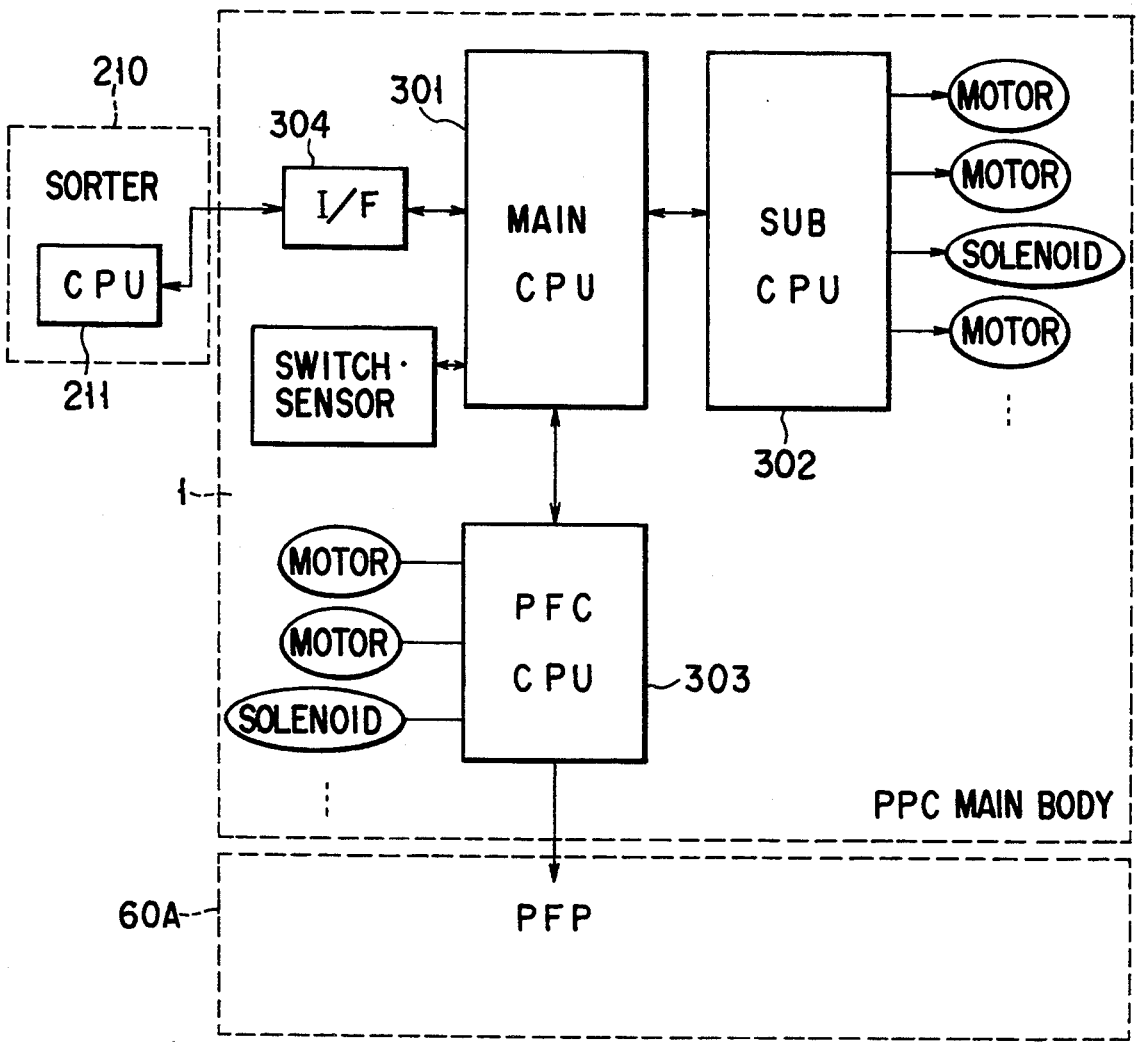
FIG. 4 is a diagram showing the control system of the image forming apparatus and the paper sheet feeding apparatus shown in FIG. 1.

The apparatus of the above embodiment comprises a control system as shown in FIG. 4.

The main body 1 includes a main CPU (main control means) 301, a sub CPU 302, and a paper sheet feeding CPU 303. The sub CPU 302 controls the optical and driving systems in the main body 1, and the paper sheet feeding CPU 303 controls the feeding system therein.

The paper sheet feeding CPU 303 also controls the direction of rotation of the driving motor 75 in the sheet feeding apparatus 60A, i.e., an external device.

For example, under control of the paper sheet feeding CPU 303, when the image forming speed of the image forming apparatus is 125 mm/s, the driving motor 75 is rotated in a direction of the arrow a in FIG. 2, and when the image forming speed is 250 mm/s, the driving motor 75 is rotated in a direction of the arrow b in FIG. 2. Thus, paper sheets are fed in accordance with the image forming speed.

If a sorter 210 for sorting paper sheets is provided on a paper-exit side of the main body 1, the main CPU 301 in the main body 1 can be connected to a CPU 211 of the sorter 210 via an interface 304, so that the sheet transfer speed of the sorter 210 can be controlled in accordance with the image forming speed of the image forming apparatus 1A.

Figure 5:
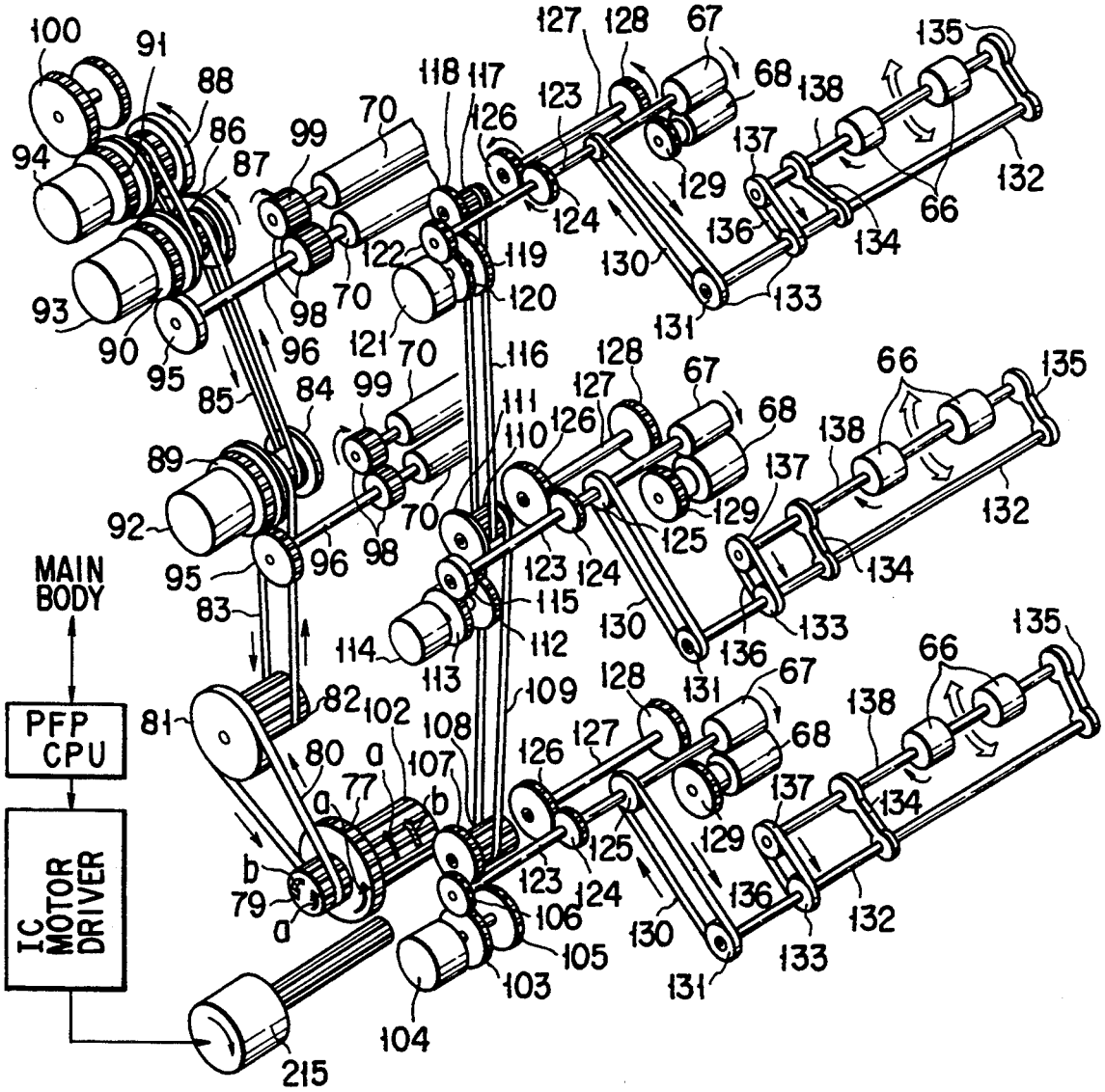
FIG. 5 is a perspective view showing the driving system of a paper sheet feeding apparatus according to another embodiment of the present invention.
Figure 6:
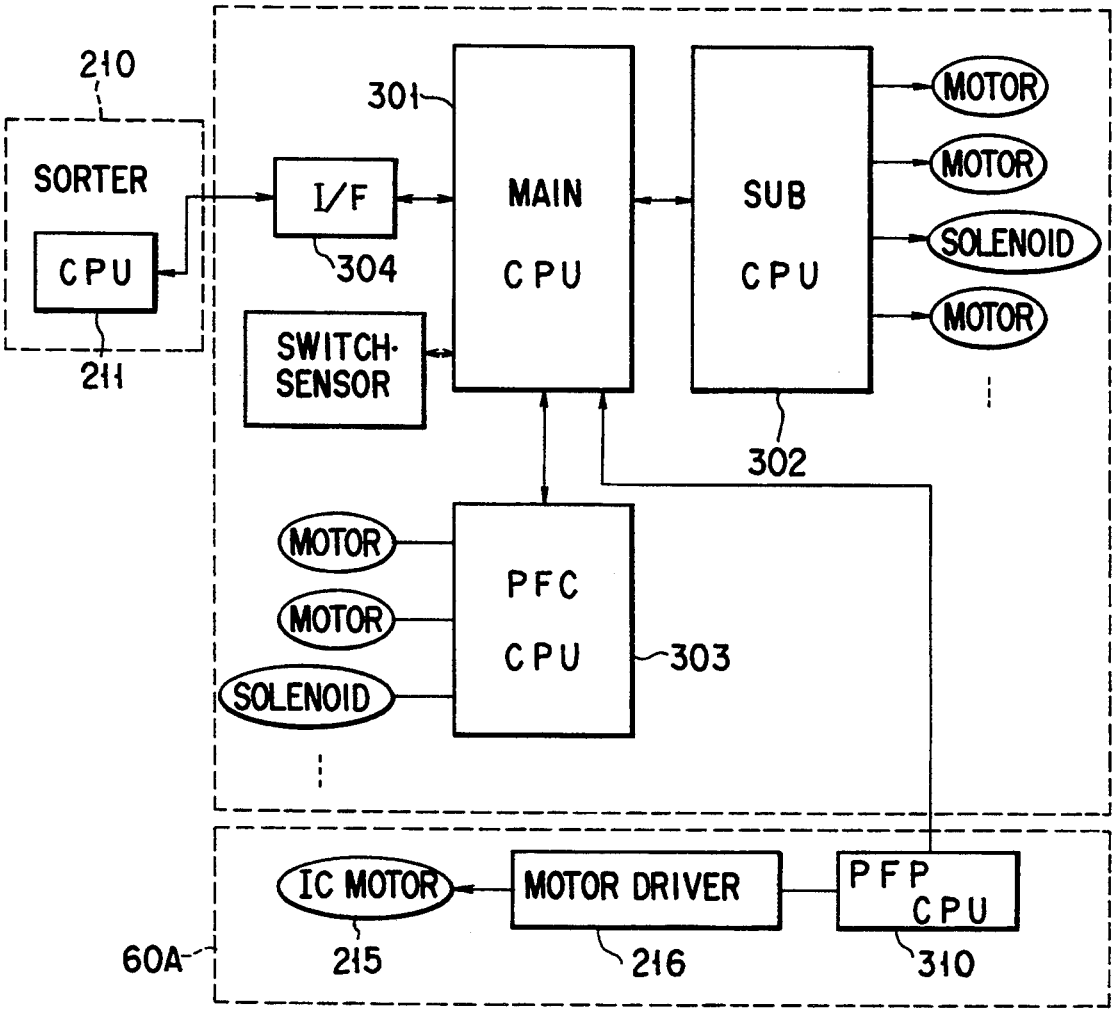
FIG. 6 is a diagram showing the control system of the paper sheet feeding apparatus shown in FIG. 5.

FIG. 5 shows another embodiment of the present invention. In this embodiment, an IC motor 215 is used as a driving motor. The rotation speed of the IC motor 215 is controlled by a control system as shown in FIG. 6.

Similarly to the above embodiment, the main body 1 includes a main CPU 301, a sub CPU 302, and a paper sheet feeding CPU 303. The control system shown in FIG. 6 additionally comprises a CPU 310 for the IC motor 215 in the sheet feeding apparatus 60A. The CPU 310 is connected to the main CPU 301 in the main body 1.

In an image forming process, sheet feeding speed data is supplied from the main CPU 301 of the main body 1 to the CPU 310 of the sheet feeding apparatus 60A. The CPU 310 causes the IC motor 215 to be driven by a motor driver 216 at a rate in accordance with the sheet feeding speed data.

According to this embodiment, the sheet transfer speed can be changed in a stepless manner in accordance with the image forming speed. In other words, the paper sheet feeding apparatus can transfer paper sheets at more various speeds.

In the above embodiment, the CPU 303 in the main body 1 controls the sheet feeding system only in the main body.

Figure 7:
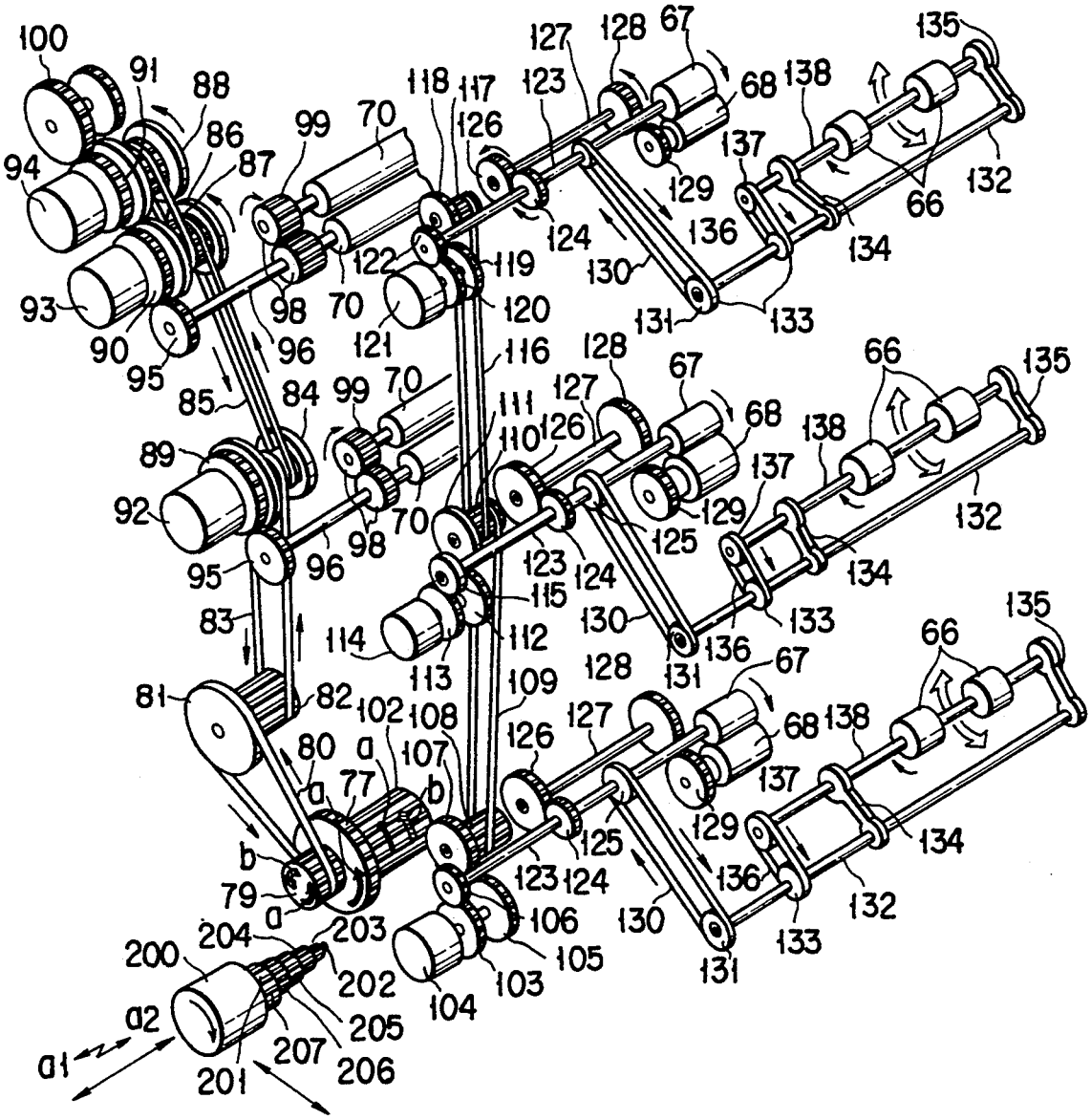
FIG. 7 is a diagram showing the driving system of the paper sheet feeding apparatus according to still another embodiment of the present invention.

FIG. 7 shows still another embodiment of the present invention.

In this embodiment, a driving motor 200 is mounted on a slider (not shown) movable in directions indicated by arrows $a_1$ and $a_2$ in FIG. 7. A driving gear 201 of the motor 200 includes a plurality of gear portions 202 to 207 having different numbers of teeth.

In an image forming process, sheet feeding speed data is supplied from the main CPU 301 of the main body 1 to the CPU 310 of the sheet feeding apparatus 60A. The CPU 310 causes the driving gear 201 to move in a direction of the arrow $a_1$ or $a_2$ in accordance with the sheet feeding speed data, so that one of the gear sections 202 to 207 having a desired number of teeth can be selectively engaged with the gear 77. As a result, the rotation rate can be changed and the sheet transfer speed can be controlled.

In the embodiment shown in FIG. 7, a plurality of switching buttons (not shown) may be provided on the sheet feeding apparatus 60A, instead of using a CPU 310. The amount of movement of the slider of the driving motor 200 is changed by operating the switching buttons, so that one of the gear sections 202 to 207 having a desired number of teeth can be selectively engaged with the gear 77. As result, the rotation rate can be changed and accordingly the sheet transfer speed can be controlled.

As has been described above, according to the present invention, since the sheet transfer speed can be changed in accordance with the image forming speed, it is unnecessary to provide paper sheet feeding apparatuses of a number which coincide with the number of types of the image forming apparatuses, and the cost can be reduced.

In addition, unlike a case where the driving mechanism of the paper sheet feeding apparatus is replaced by another one, no trouble and time are required for setup.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. A paper feeding apparatus, selectively connectable to one of a first image forming apparatus for transporting paper sheets at a first transporting speed and for forming an image on the paper sheets, and a second image forming apparatus for transporting paper sheets at a second transporting speed different than the first transporting speed and for forming an image on the paper sheets, the paper feeding apparatus comprising:

storing means for storing a plurality of paper sheets;

feeding means for feeding the paper sheets from the storing means to the first image forming apparatus, when the paper feeding apparatus is connected to the first image forming apparatus, and for feeding the paper sheets from the storing means to the second image forming apparatus, when the paper feeding apparatus is connected to the second image forming apparatus;

receiving means for receiving information on the first transporting speed from the first image forming apparatus, when the paper feeding apparatus is connected to the first image forming apparatus, and for receiving information on the second transporting speed from the second image forming apparatus, when the paper feeding apparatus is connected to the second image forming apparatus; and control means for controlling the feeding means so as to feed paper sheets at the first transporting speed in accordance with the information on the first transporting speed received by the receiving means, when the paper feeding apparatus is connected to the first image forming apparatus, and for controlling the feeding means so as to feed paper sheets at the second transporting speed in accordance with the information on the second feeding speed received by the receiving means, when the paper feeding apparatus is connected to the second image forming apparatus.

2. A paper feeding apparatus according to claim 1, wherein said feeding means includes an IC motor whose rotational speed is adjustable.

* * * * *